US005125458A

United States Patent [19]

Berman

[11] Patent Number: 5,125,458

[45] Date of Patent: Jun. 30, 1992

[54] FIRE FIGHTING APPARATUS

[76] Inventor: Steve A. Berman, 4815 Azucina Rd., Woodland Hills, Calif. 91364

[21] Appl. No.: 646,817

[22] Filed: Jan. 28, 1991

[51] Int. Cl.[5] ..... A62C 35/68

[52] U.S. Cl. ..... 169/16; 169/13; 169/20; 169/23; 169/61

[58] Field of Search ..... 169/13, 16, 19, 20, 169/23, 56, 60, 61

[56] References Cited

U.S. PATENT DOCUMENTS

| | | | |
|---|---|---|---|
| 1,939,764 | 12/1933 | Chandler | 169/13 |
| 4,330,040 | 5/1982 | Ence et al. | 169/13 |
| 4,428,434 | 1/1984 | Gelaude | 169/13 |
| 4,836,290 | 6/1989 | Le Lande, Jr. | 169/13 X |
| 4,991,657 | 2/1991 | Le Lande, Jr. | 169/13 X |

FOREIGN PATENT DOCUMENTS

| | | | |
|---|---|---|---|
| 2603194 | 3/1988 | France | 169/13 |
| 635998 | 12/1978 | U.S.S.R. | 169/13 |

*Primary Examiner*—Margaret A. Focarino
*Assistant Examiner*—Andrew C. Pike
*Attorney, Agent, or Firm*—Roger A. Marrs

[57] ABSTRACT

Fire fighting apparatus has a fire retardant or fire quenching system mounted on a structure operative in response to detection of fire to take water from a reserve supply in the absence of main water line or supply flow or pressure. The reserve supply may be a reservoir such as a pool or it may be unpressurized water in the main water line. Detection is achieved via remote temperature or smoke sensors as examples as well as remote actuators such as telephone or portable signal transmitting units. Power is supplied by battery connection to motors, pump, and relays for oprating the apparatus and valves are selectively disposed in an interconnecting pumping network with the pump and motor to conduct water from the reserve supply.

7 Claims, 1 Drawing Sheet

FIRE FIGHTING APPARATUS

BACKGROUND OF THE INVENTION

1. Field of the Invention

The present invention relates to fire prevention systems, and more particularly to a novel fire prevention system having fire quenching elements mounted on a structure and having temperature, smoke or other detector means interiorly or externally mounted or remotely carried for controlling distribution of a reserve supply of water to the fire quenching elements in the absence of main water line pressure or water flow.

2. Brief Description of the Prior Art

In the past, it has been the conventional practice to employ a variety of water systems for controlling fires which frequently occur in a dwelling or building or outside in adjacent fields or remote areas. Usually, sprinkler systems are extended across the roof and are activated by manually turning valves to supply the sprinklers with pressurized water from a main line supply. In some instances, the valves are connected to an automatic fire detection system which is internally mounted in the dwelling and that senses a combustible condition which then automatically operates the valves. Similar systems are employed to release water or other fire retardant materials in remote areas such as fields, yards, forest areas, or the like.

Although these prior systems have been successful for their intended purposes, it is noted that the systems are usually located on the dwelling or building and that the sensing or detection is achieved only when a combustible condition is present. These prior systems usually operate upon the detection of heat through temperature sensing and require pressure of the main line water supply. Although smoke detectors are available, the smoke detectors are generally used in connection with alarms that are either visual or audible and do not control nor compensate for loss of main line pressure or fluid flow.

Other problems and difficulties are encountered with conventional fire alarm and detection systems which stem largely from the fact that actuation of the systems cannot be achieved remotely nor can the systems be actuated by a variety of environmental conditions. For example, actuation may be needed in order to prevent a building from igniting when a fire is nearby. In this instance, detection by temperature and/or smoke would be needed rather than actual fire conditions. Secondly, a person may wish to remotely control actuation of a water system through the use of telephone or a portable transmitter, while a desirable feature would be to simultaneously alert a remotely located service organization or fire-fighting unit.

Furthermore, current systems may utilize swimming pool water as a reserve supply. No system utilizes the water supply or volume in the main line in the absence of pressure or flow.

Therefore, a long-standing need has existed to provide an improved fire sensing and detection system which not only detects a drop in water main line pressure and/or flow but further senses the presence of water in the main line and provides for remote as well as automatic operation of the system from a variety of sensors and signal sources.

SUMMARY OF THE INVENTION

Accordingly, the above problems and difficulties are obviated by the present invention which provides a novel means for quenching or retarding a fire which includes a fire-quenching system, such as sprinklers which are operably connected to a main line of pressurized water. Sensors are provided for detecting a drop in main line water pressure or flow and a motor pump arrangement is operably coupled to a reserve supply of water which, in response to main line pressure drop and/or flow, pumps the water to the sprinkler system. A plurality of remote actuators are provided which may take the form of a portable transmitter, a telephone transmission network, heat sensors, smoke detectors, and the like. Also, a back-up power supply is provided for motor operation taking the form of batteries, and a latching relay is coupled thereto for supplying power in response to sensor or remote actuation of the detectors.

Therefore, it is among the primary objects of the present invention to provide a novel fire-quenching or retardation system which includes means for sensing a pressure drop or water flow in main line water pressure which is then translated into motor operation for supplying a reserve volume or supply of water to a fire retardant means such as a sprinkling system.

Another object of the present invention is to provide a novel means of compensating for a drop in main line water pressure or flow by utilizing a reserve supply of water responsive to the pressure drop or flow via sensors and detectors as well as remote actuators. The reserve supply may be a reservoir, pool, or volume of water in the main line.

Still another object of the present invention is to provide an automatic fire fighting system whereby the system may be operated by signals generated remotely from portable transmitters and/or environmental sensors so that a reserve water source can be placed on line in the absence of main line water pressure or flow. Water volume in the main line is considered a reserve water source as well as pools or the like.

Another object resides in switching the system back to main line supply when flow and/or pressure returns to the main line.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
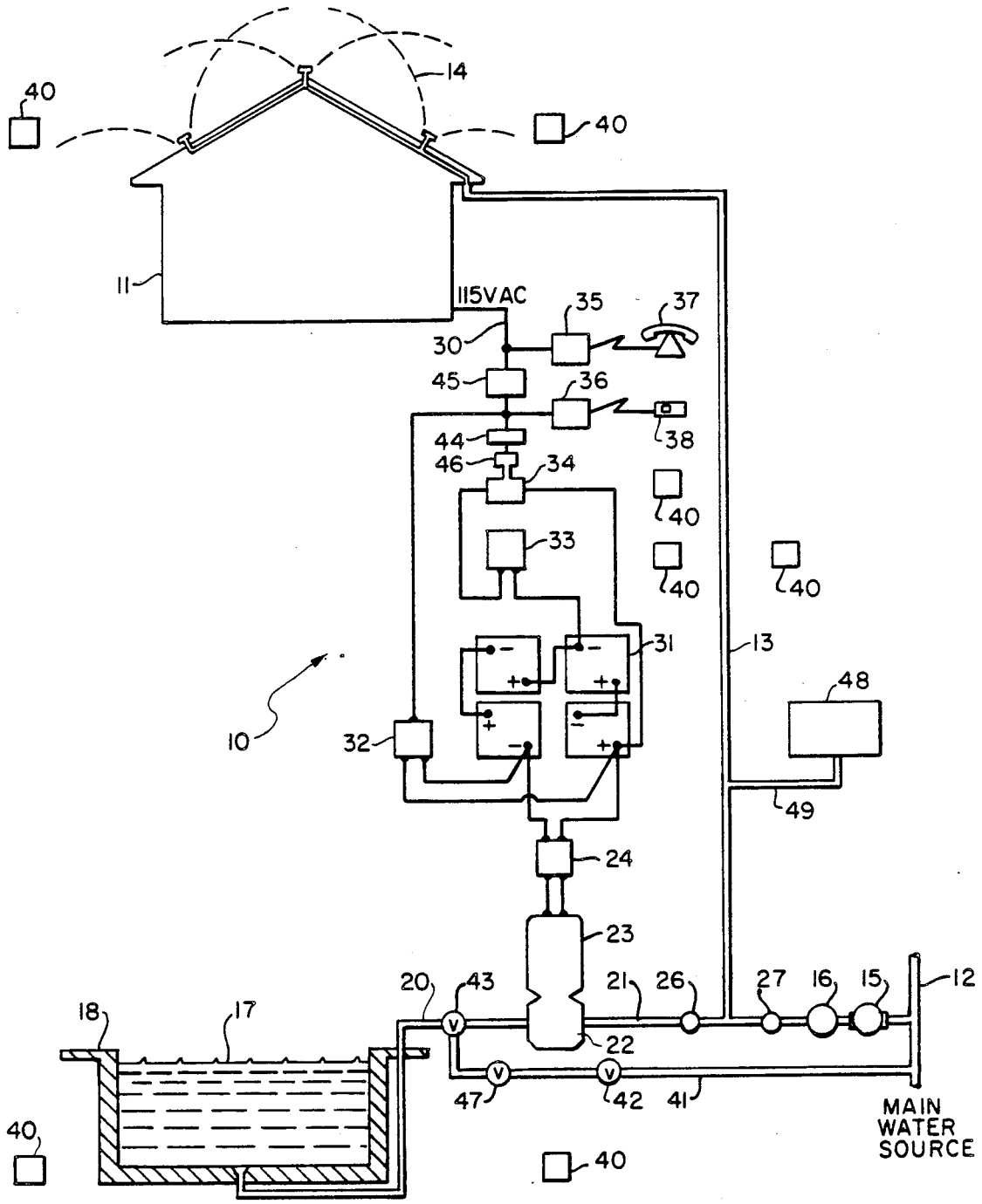
FIG. 1 is a diagrammatic view showing the novel fire fighting system of the present invention in which a reserve supply of water may be placed on line with a fire-quenching or retardant system by any one of a plurality of actuators and sensors.

Referring to FIG. 1, the novel fire fighting system of the present invention is illustrated in the general direction of arrow 10 that is intended to service a dwelling 11 coupled to a main water source 12 for receiving pressurized water intended to service the various utilities of the dwelling. The system of the present invention is coupled to the main water source by means of a conduit 13 connected at one end to a fire-quenching or retardant means, such as a plurality of sprinklers, as indicated by numeral 14. The opposite end of conduit 13 is coupled to the main water source 12 through a pressure sensor switch 15 and a sprinkler water actuator 16. Coupled in parallel to the conduit 13 is a source of alternate or reserve water, indicated by numeral 17, such as water that may be held in a conventional swimming pool 18. However, it is to be understood that the reservoir may take other forms, such as water storage tanks or the like or unpressurized standing water in conduit 12. The reserve water supply 17 is coupled to the conduit 13 via pipes 20 and 21 via a pump 22 operated by a motor 23 from a starter means 24. Check valves 26 and 27 assure that there will be no backing of the water through the respective pipes or conduits from either the main water source or the reserve water supply and determine which side has more pressure.

The motor 23 may be operated from a 115 volt A.C. system 30 or by a 24 volt battery system 31. A battery charger 32 is coupled into the line power network so that the batteries can be charged when not in use. An inverter 33 is employed for converting D.C. voltage to A.C. voltage and a latching relay 34 is responsive to signals from receivers, such as indicated by receivers 35 and 36 generating signals when activated by a telephone 37 or a portable remote transmitter 38. Other remote detectors or sensors may be provided, such as temperature sensors 40 which are remotely located about the grounds or acreage surrounding the dwelling 11. The sensors 40 send activating signals to the receivers which energize the latching relay and cause additional signals to actuate remote monitoring devices by telephone which may actuate audible and/or visual alarms or displays. It is to be understood that the sensors or detectors 40 may take the form of temperature sensors, smoke detectors, or the like.

It is also to be noted that the reserve water supply line 20 is connected to the main water source pipe 12 via a conduit 41 which includes a water actuator valve 42. A two-way valve for permitting the drawing of water from either reserve water in the pool or in the main water line couples the conduit 41 to the conduit 20 and is indicated by numeral 43. The main line water supply is monitored to detect water volume and flow of main line water. If water flow becomes insufficient, the valve switches to the reserve or back-up water supply. Therefore, it can be seen that the pump 22 may draw or extract water from the presence of water in the line 12 in the event of water pressure or flow loss. Water can be taken from the main line in the event that there is no pressure or flow but when water is still available. However, when there is no water at all in the main water line, then this condition is sensed and the pump is switched to the alternate reserve supply such as reservoir or pool 17.

A receiver 44 is used for the wireless heat sensors and monitors these sensors on an hourly basis as a testing procedure to ensure that the sensors and detectors are operating. In this connection, a call alarm 45 is included notifying a remote location when the system requires service. Also, a monitoring service is notified when any sensor or transmitter 37, 38, or 40 causes activation and sets off an audible alarm. Additionally, the monitoring service is alerted as to which sensor or source of signal has caused the actuation. As part of the testing procedure, a sensor 46 monitors house current. If there is a loss in house current, the sensor 45 operates as a switch to turn on the back-up power represented by batteries or other alternate electrical power source systems.

Therefore, it can be seen that the pressure switch 15 monitors the main water pressure in line 12 and if there is a drop or loss of pressure, back-up pump 22 is turned on and reserve water is withdrawn from the static supply in the main line via line 41 and supplied to the sprinkler system via line 13. In the event insufficient water volume is detected by water flow detector 47, the switch 43 will permit withdrawal of reserve water from the pool 17. The sprinkler valve actuator 16 turns on the flow for the sprinklers. Check valves 26 and 27 are one-way valves for maintaining the water flow in the direction of the sprinkler system. The back-up batteries 31 may be employed in connection with the inverter 33 to supply proper voltage to the starter 24 to energize the motor 23 for driving the pump 22. The battery charger 32 may be employed to maintain full charge on the battery system and the inverter converts 12-volt D C. to 115 V.A.C. The telephone actuator 37 will energize the system by means of a phone call remotely made by the user of the system and the remote receiver or sensor 36 activates the system or alarm service through a remote and portable actuator 38. Heat, temperature, or remote sensors 40 monitor the surrounding environment and, when activated, will energize the system and notify the alarm service. Industrial sprinklers of a suitable type may be mounted on the roof of the dwelling 11 or any outside environment such as fields, yards, forests, or commercial structures, and are directed to conduct a fire-quenching spray of water completely around the house.

It is to be noted that the fire-quenching spray may be a substance other than water, such as a fire retardant or a mixture of water and fire retardant chemical. A storage source for the retardant is indicated by hopper 48 connected to conduit 13 by a supply conduit 49.

Release and distribution of the fire-quenching substance or spray may be beyond the house or structure on which the sprinklers are located, such as other outside areas intended to be protected.

The sensors are coupled to the system so that, when activated, sensor 46 will alert an alarm service that will respond in the case of a full activation, or the sensor may be employed for alerting a fire department in the case of an actual fire situation. Additionally, the system may be turned "OFF" in the event of a false alarm.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. Fire-fighting apparatus comprising:

a normally pressurized main line supply of normally pressurized water;

distribution means connected to said main line supply for selectively discharging said water over a dispersal area;

switch means operably coupling said main line supply with said distribution means for conducting said water from said main line supply to said distribution means for dispersal of said water; and sensing means, operatively connected between said main line supply and said switch means, for sensing water pressure loss and water flow loss in said main line supply indicating standing unpressurized water in said main line supply when said main line supply becomes unpressurized, and for operating said switch means in response to said sensing of said water pressure loss and said water flow loss to conduct said unpressurized water from said main line supply to said distribution means when said main line supply becomes unpressurized.

2. The invention as defined in claim 1 further including:

a reservoir of water;

conduit means including a valve device connecting said reservoir to said distribution means;

said switch means and said sensing means connected in parallel with said main line supply and said reservoir; and said switch means including selection means for alternately selecting the standing unpressurized water in said main line supply and reservoir water in said reservoir respectively.

3. The invention as defined in claim 2 further including:

a pumping means connected in series to said distribution means and in parallel with said main line supply and said reservoir.

4. The invention as defined in claim 3 wherein:

said distribution means is a sprinkler network.

5. The invention as defined in claim 4 wherein:

the water in said reservoir of the water and the standing unpressurized water in said main line supply constitute a reserve supply of water.

6. The invention as defined in claim 5 further including:

a plurality of environmental detectors connected to said pumping means for commencing pump operation in response to a presence of environmental conditions such as temperature, smoke, manual initiation, and telephonic initiation.

7. The invention as defined in claim 6 further including:

a line voltage source and a battery voltage source coupled in parallel to said pumping means; and switch means connected between said line voltage and battery voltage sources for selecting either of said sources for the operation of said pumping means.

* * * * *